US009200639B2

(12) United States Patent
Li et al.

(10) Patent No.: US 9,200,639 B2
(45) Date of Patent: Dec. 1, 2015

(54) COMPRESSOR HOUSING ASSEMBLY

(75) Inventors: Penny Li, Shanghai (CN); Hua Chen, Shanghai (CN)

(73) Assignee: Honeywell International Inc., Morristown, NJ (US)

( * ) Notice: Subject to any disclaimer, the term of this patent is extended or adjusted under 35 U.S.C. 154(b) by 613 days.

(21) Appl. No.: 13/589,171

(22) Filed: Aug. 19, 2012

(65) Prior Publication Data

US 2014/0050576 A1 Feb. 20, 2014

(51) Int. Cl.

| | |
|---|---|
| ***F04D 29/44*** | (2006.01) |
| ***B23P 15/00*** | (2006.01) |
| ***F04D 29/42*** | (2006.01) |
| ***F04D 29/62*** | (2006.01) |

(52) U.S. Cl.

CPC ..... *F04D 29/4206* (2013.01); *F04D 29/624* (2013.01); *Y10T 29/49236* (2015.01)

(58) Field of Classification Search

CPC . F04D 25/04; F04D 29/4206; F04D 29/4213; F04D 29/441; F04D 29/624; F02C 6/12

See application file for complete search history.

(56) References Cited

U.S. PATENT DOCUMENTS

| | | | | |
|---|---|---|---|---|
| 3,071,313 | A * | 1/1963 | Weisel | 415/204 |
| 4,381,171 | A * | 4/1983 | Chapple | 415/204 |
| 4,521,155 | A | 6/1985 | Osborn | |
| 5,246,352 | A | 9/1993 | Kawakami | |
| 5,266,003 | A * | 11/1993 | Warren | 415/208.3 |
| 5,549,449 | A * | 8/1996 | McInerney et al. | 415/177 |
| 5,961,281 | A * | 10/1999 | Ojima et al. | 415/173.6 |
| 5,980,203 | A * | 11/1999 | Zatorski et al. | 415/173.4 |
| 6,193,463 | B1 | 2/2001 | Adeff et al. | |

FOREIGN PATENT DOCUMENTS

| | | | |
|---|---|---|---|
| EP | 2441965 | A1 | 4/2012 |
| JP | 2001234753 | A | 8/2001 |

* cited by examiner

*Primary Examiner* — Igor Kershteyn
(74) *Attorney, Agent, or Firm* — Brian J. Pangrle

(57) ABSTRACT

A compressor housing assembly can include a shell that includes a cylindrical wall portion including a fluid inlet opening at one end and a sloped mating surface at an opposing end and, extending radially outwardly from the cylindrical wall portion, a spiral wall portion that defines, in part, a volute; and an insert that includes a cylindrical wall portion including a fluid inlet opening at one end and a shroud surface at an opposing end and, extending radially outwardly from the cylindrical wall portion, an annular ring portion including a sloped mating surface and, extending from the shroud surface, a diffuser surface, where, in an assembled state, the sloped mating surface of the insert and the sloped mating surface of the shell form a sloped interface between the insert and the shell. Various other examples of devices, assemblies, systems, methods, etc., are also disclosed.

19 Claims, 12 Drawing Sheets

COMPRESSOR HOUSING ASSEMBLY

TECHNICAL FIELD

Subject matter disclosed herein relates generally to turbomachinery for internal combustion engines and, in particular, to compressor housing assemblies.

BACKGROUND

Centrifugal compressors typically include a compressor housing assembly to house a compressor wheel that can direct fluid to a diffuser and, subsequently, to a volute. In such an arrangement, a compressor housing assembly may include a unitary component that includes one or more surfaces that define at least a portion of the diffuser and one or more surfaces that define at least a portion of the volute. As an example, a compressor housing assembly may include a plate that attaches to a unitary component cast via a casting process such as sand casting. In such an example, the unitary component may be cast by introducing molten alloy about a removable sand core to form a volute wall as well as a diffuser wall where, upon assembly, an upper surface of the plate acts to enclose the volute and to form the diffuser section.

As another example, a compressor housing assembly may include a plate and one or more components formed via a die-casting process. In such an arrangement, a volute may still be enclosed by the plate, but defined by more than one component due to processing constraints associated with die-casting. For example, while sand casting may provide for a unitary component with a volute wall having a circular cross-section due to removability of sand, die-casting benefits from reusable die pieces that are positionable to form a mold cavity for receipt of molten alloy and positionable for removal of a die-cast component formed by the alloy.

Various technologies described herein pertain to compressor housing assemblies that can include, for example, a die-cast component and an insert that can define a volute in conjunction with the die-cast component.

BRIEF DESCRIPTION OF THE DRAWINGS

A more complete understanding of the various methods, devices, assemblies, systems, arrangements, etc., described herein, and equivalents thereof, may be had by reference to the following detailed description when taken in conjunction with examples shown in the accompanying drawings where.

DETAILED DESCRIPTION

Figure 1:
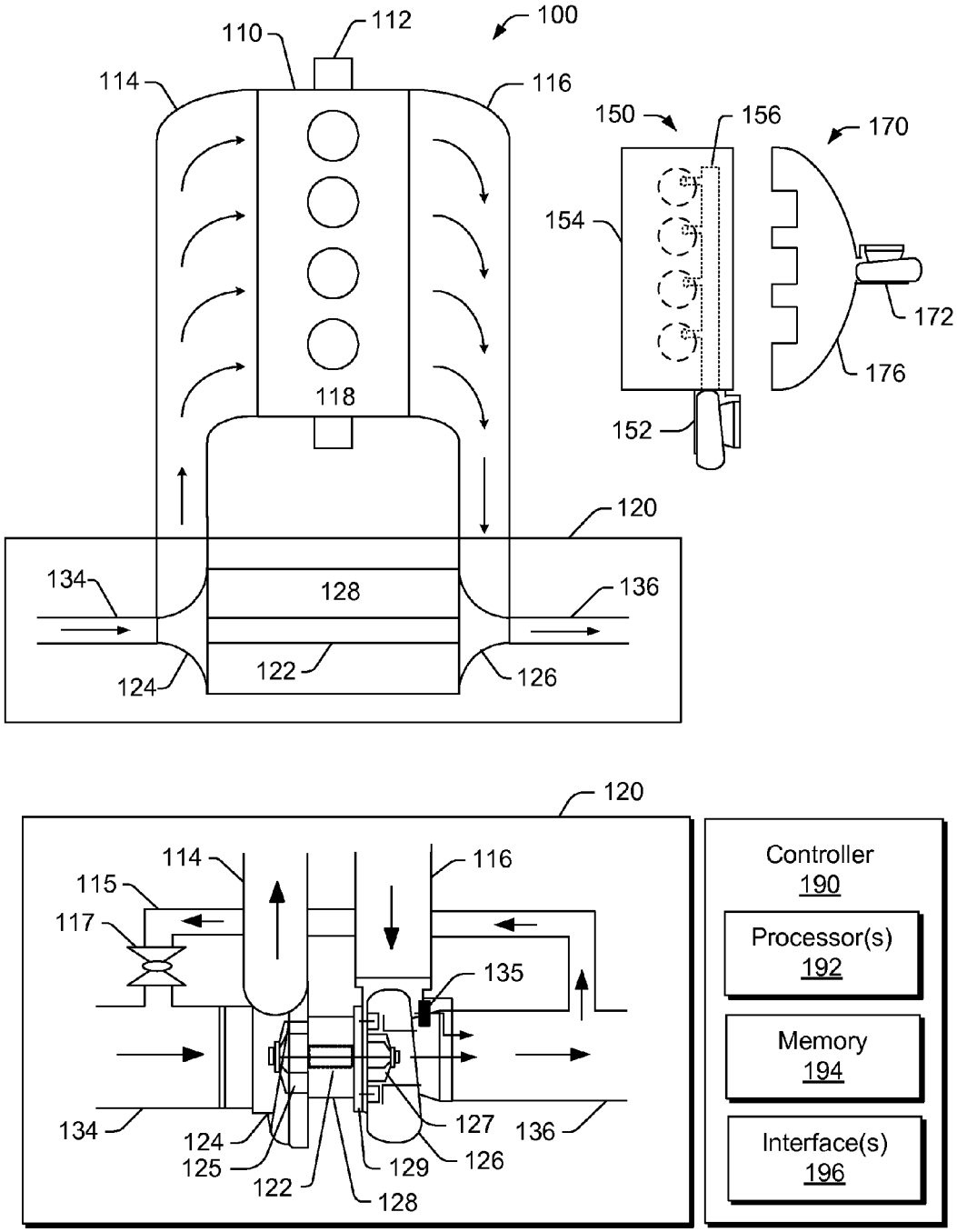
FIG. 1 is a diagram of a turbocharger and an internal combustion engine along with a controller.

Various examples of compressor housing assemblies are described herein. As an example, a compressor housing assembly can include a shell that includes a cylindrical wall portion including a fluid inlet opening at one end and a sloped mating surface at an opposing end and, extending radially outwardly from the cylindrical wall portion, a spiral wall portion that defines, in part, a volute; and an insert that includes a cylindrical wall portion including a fluid inlet opening at one end and a shroud surface at an opposing end and, extending radially outwardly from the cylindrical wall portion, an annular ring portion including a sloped mating surface and, extending from the shroud surface, a diffuser surface, where, in an assembled state, the sloped mating surface of the insert and the sloped mating surface of the shell form a sloped interface between the insert and the shell. In such an example, the shell may be a die-cast shell, for example, formed via a die-casting process.

As another example, a compressor housing assembly can include a volute of varying cross-sectional areas, each cross-sectional area having a peak defined by a semi-major axis of a semi-ellipse, a width defined by twice a semi-minor axis of the semi-ellipse, a first line extending downward from one side of the semi-ellipse at a semi-minor axis distance from a center of the semi-ellipse to one side of a throat and a second line, parallel to the first line, extending downward from another side of the semi-ellipse at a semi-minor axis distance from the center of the semi-ellipse to a sloped line that extends to another side of the throat. In such an example, a component forming the semi-ellipse shapes may be a die-cast component, for example, formed via a die-casting process.

In various examples, an insert that includes a sloped surface fits into a shell where a volute is defined in part by the sloped surface and a surface of the shell. Such a shell may be formed via a die-casting process to include a curved surface that may benefit volute fluid dynamics (e.g., reduce losses). Such a curved surface may be positioned between radially spaced walls where one wall descends to a throat and the other wall descends to form a corner with a sloped surface of an insert. In such an example, the slope angle of the sloped surface may be selected to benefit fluid dynamics when compared to, for example, a 90 degree corner. Further, where a shell has a corresponding sloped surface, a portion of the sloped surface of the insert may mate with the sloped surface of the shell (e.g., to form a sloped interface). Yet further, an insert may be symmetric about a longitudinal axis such that rotational orientation (e.g., azimuthal orientation) of the insert with respect to the shell. In such an example, an assembly process may avoid clocking of the shell and the insert, which may expedite assembly.

Below, an example of a turbocharged engine system is described followed by various examples of components, assemblies, methods, etc.

Turbochargers are frequently utilized to increase output of an internal combustion engine. Referring to FIG. 1, a conventional system 100 includes an internal combustion engine 110 and a turbocharger 120. The internal combustion engine 110 includes an engine block 118 housing one or more combustion chambers that operatively drive a shaft 112 (e.g., via pistons). As shown in FIG. 1, an intake port 114 provides a flow path for air to the engine block 118 while an exhaust port 116 provides a flow path for exhaust from the engine block 118.

The turbocharger 120 acts to extract energy from the exhaust and to provide energy to intake air, which may be combined with fuel to form combustion gas. As shown in FIG. 1, the turbocharger 120 includes an air inlet 134, a shaft 122, a compressor housing assembly 124 for a compressor wheel 125, a turbine housing assembly 126 for a turbine wheel 127, another housing assembly 128 and an exhaust outlet 136. The housing 128 may be referred to as a center housing assembly as it is disposed between the compressor housing assembly 124 and the turbine housing assembly 126. The shaft 122 may be a shaft assembly that includes a variety of components. The shaft 122 may be rotatably supported by a bearing system (e.g., journal bearing(s), rolling element bearing(s), etc.) disposed in the housing assembly 128 (e.g., in a bore defined by one or more bore walls) such that rotation of the turbine wheel 127 causes rotation of the compressor wheel 125 (e.g., as rotatably coupled by the shaft 122). As an example a center housing rotating assembly (CHRA) can include the compressor wheel 125, the turbine wheel 127, the shaft 122, the housing assembly 128 and various other components (e.g., a compressor side plate disposed at an axial location between the compressor wheel 125 and the housing assembly 128).

In the example of FIG. 1, a variable geometry assembly 129 is shown as being, in part, disposed between the housing assembly 128 and the housing assembly 126. Such a variable geometry assembly may include vanes or other components to vary geometry of passages that lead to a turbine wheel space in the turbine housing assembly 126. As an example, a variable geometry compressor assembly may be provided.

In the example of FIG. 1, a wastegate valve (or simply wastegate) 135 is positioned proximate to an exhaust inlet of the turbine 126. The wastegate valve 135 can be controlled to allow exhaust from the exhaust port 116 to bypass the turbine 126. Further, an exhaust gas recirculation (EGR) conduit 115 may be provided, optionally with one or more valves 117, for example, to allow exhaust to flow to a position upstream the compressor wheel 125.

FIG. 1 also shows an example arrangement 150 for flow of exhaust to an exhaust turbine housing assembly 152 and another example arrangement 170 for flow of exhaust to an exhaust turbine housing assembly 172. In the arrangement 150, a cylinder head 154 includes passages within to direct exhaust from cylinders to the turbine housing assembly 152 while in the arrangement 170, a manifold 176 provides for mounting of the turbine housing assembly 172, for example, without any separate, intermediate length of exhaust piping. In the example arrangements 150 and 170, the turbine housing assemblies 152 and 172 may be configured for use with a wastegate, variable geometry assembly, etc.

In FIG. 1, an example of a controller 190 is shown as including one or more processors 192, memory 194 and one or more interfaces 196. Such a controller may include circuitry such as circuitry of an engine control unit (ECU). As described herein, various methods or techniques may optionally be implemented in conjunction with a controller, for example, through control logic. Control logic may depend on one or more engine operating conditions (e.g., turbo rpm, engine rpm, temperature, load, lubricant, cooling, etc.). For example, sensors may transmit information to the controller 190 via the one or more interfaces 196. Control logic may rely on such information and, in turn, the controller 190 may output control signals to control engine operation. The controller 190 may be configured to control lubricant flow, temperature, a variable geometry assembly (e.g., variable geometry compressor or turbine), a wastegate (e.g., via an actuator), an electric motor, or one or more other components associated with an engine, a turbocharger (or turbochargers), etc.

Figure 2:
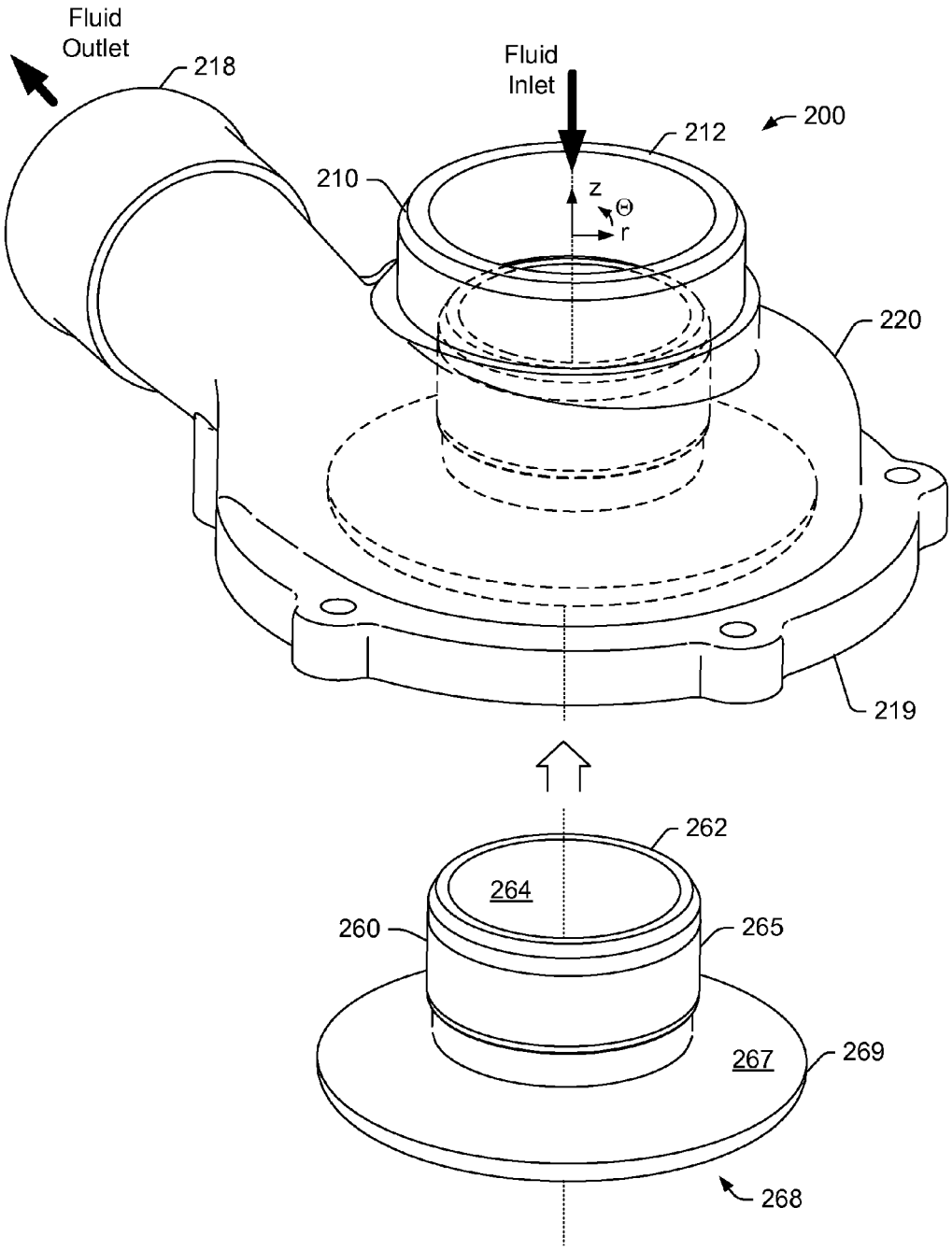
FIG. 2 is a perspective view of an example of a compressor housing assembly.

FIG. 2 shows an example of a compressor housing assembly 200 that includes a shell 210 and an insert 260 along with a cylindrical coordinate system that includes an axial coordinate z, a radial coordinate r and an azimuthal (e.g., angular) coordinate Θ. In the example of FIG. 2, the shell 210 includes a cylindrical wall portion including a fluid inlet opening 212 at one end and a sloped mating surface at an opposing end (not shown) and, extending radially outwardly from the cylindrical wall portion, a spiral wall portion 220 that defines, in part, a volute. In the example of FIG. 2, the insert 260 includes a cylindrical wall portion including a fluid inlet opening 262 at one end and a shroud surface at an opposing end (not shown) and, extending radially outwardly from the cylindrical wall portion, an annular ring portion including a sloped mating surface 267 and, extending from the shroud surface, a diffuser surface 268. In an assembled state, the sloped mating surface 267 of the insert 260 and the sloped mating surface of the shell 210 form a sloped interface between the insert 260 and the shell 210.

In the example of FIG. 2, the insert 260 may be symmetric about a longitudinal axis (e.g., corresponding to an axis of rotation of a compressor wheel positioned at least partially within the insert 260). In such an example, the insert 260 may be inserted into the shell 210 at any angular orientation of the insert 260 about its longitudinal axis. Such an arrangement may facilitate an assembly process for assembling the compressor housing assembly 200 as insertion of the insert 260 into the shell 210 does not require that the insert 260 be in any particular rotational relationship with respect to the shell 210. For example, such an assembly process may include merely inserting the insert 260 into the shell 210 to seat the insert 260 in the shell 210 and achieve alignment of the longitudinal axis of the insert 260 and a longitudinal axis of the shell 210.

Figure 3:
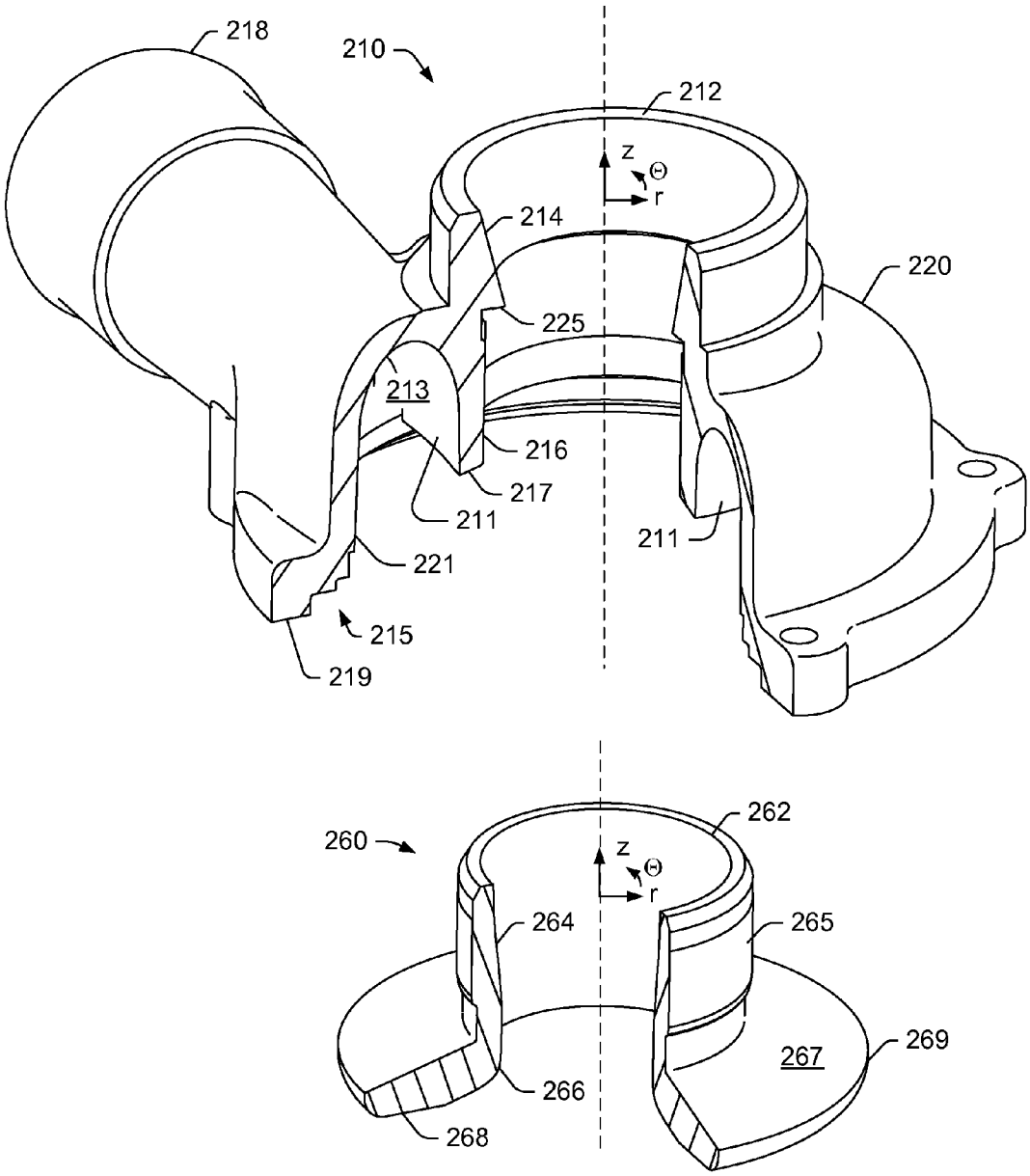
FIG. 3 is a perspective cut-away view of the compressor housing assembly of FIG. 2.

FIG. 3 shows an exploded perspective cutaway view of the compressor housing assembly 200 of FIG. 2. In the example of FIG. 3, an approximately 90 degree section of the shell 210 and an approximately 90 degree section of the insert 260 are removed to facilitate a description of various features, including the sloped mating surfaces.

As shown in FIG. 3, the cylindrical wall portion of the shell 210 includes the fluid inlet opening 212 and an angled wall 214 that forms a shoulder 225 with a seating wall 216, which extends axially to an inner edge of the sloped mating surface 217. Moving radially outwardly from an outer edge of the sloped mating surface 217, the shell 210 includes an inner surface 211 of the spiral wall 220 that has varying cross-sectional area with respect to angular position about the longitudinal axis of the shell 210, in a shape somewhat akin to an inverted U, to define, in part, a volute 213. The shell 210 also includes a recess 215, for example, for receipt of a plate, and a substantially annular base surface 219, for example, which may include features for attaching the shell 210 to a center housing assembly (see, e.g., the center housing assembly 128 of FIG. 1). As shown, the volute 213 may be a conduit for passage of fluid to a fluid outlet opening 218, which may be formed by an extension of the spiral wall portion 220 (e.g., optionally in a direction tangent to a radius from the longitudinal axis of a spiral that defines the volute 213).

As to the insert 260, it includes the fluid inlet opening 262 and an angled wall 264 that extends axially downward to the shroud surface 266, from which continues radially outwardly, the diffuser surface 268. The insert 260 also includes a seating surface 265 disposed between an axial position of the fluid inlet opening 262 and an axial position of the sloped mating surface 267. As shown in the example of FIG. 3, the sloped mating surface 267 and the diffuser surface 268 meet at a contoured edge 269, which may define a maximum diameter of the insert 260.

In the example of FIG. 3, the seating wall 216 and the shoulder 225 of the shell 210 define a socket for receipt of the cylindrical wall portion of the insert 260. Specifically, the insert 260 may be inserted into the socket to position the sloped mating surface 267 of the insert 260 adjacent to the sloped mating surface 217 of the shell 210. Once positioned, an interface may be formed between the sloped mating surfaces 217 and 267, optionally with a gasket, bonding material, etc., disposed therebetween (e.g., for purposes of material differences, heat transfer, insulation, vibration, leakage, etc.). Further, once positioned, the contoured edge 269 of the insert 260 and a radially adjacent region 221 of the inner surface 211 of the spiral wall portion 220 form an annular throat that can receive fluid from a diffuser section and direct the received fluid to the volute 213.

As to the volute 213, in the example of FIG. 3, it is defined in part by the inner surface 211 of the spiral wall portion 220 of the shell 210 and in part by the sloped mating surface 267 of the insert 260 that extends outwardly past the outer edge of the sloped mating surface 217 of the shell 210.

Figure 4:
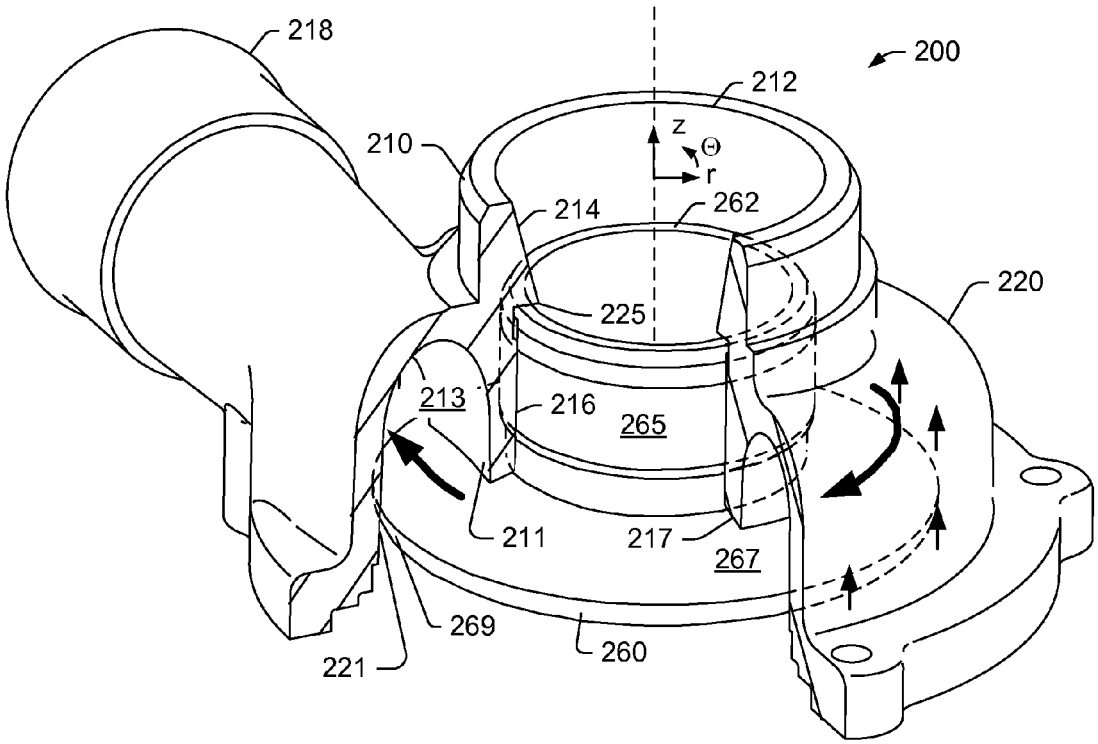
FIG. 4 is another perspective cut-away view of the compressor housing assembly of FIG. 2.

FIG. 4 shows a perspective view of the assembly 200 of FIG. 2 with the cutaway shell 210 as in FIG. 3. In the example of FIG. 4, the end of the insert 260 having the fluid inlet opening 262 is received adjacent to the shoulder 225 of the socket of the shell 210, the seating surface 265 of the insert 260 is received adjacent to the seating surface 216 of the shell 210, and the sloped mating surface 267 of the insert 260 is received adjacent to the sloped mating surface 217 of the shell 210. In the assembled state of FIG. 4, the assembly 200 includes the aforementioned annular throat defined by the contoured edge 269 of the insert 260 and the lower region 221 of the inner surface 211 of the spiral wall portion 220 of the shell 210. Various arrows indicate approximate directions of fluid flow for operation of the assembly 200 in, for example, a turbocharger (see, e.g., the turbocharger 120 of FIG. 1). As indicated, fluid flow in the annular throat may be predominantly axially upwardly in a direction parallel to the aligned longitudinal axes of the shell 210 and the insert 260; whereas, in the volute 213, especially near the center, fluid flow is in directions tangential to radii measured from the aligned longitudinal axes, which may define a spiral.

During operation of a turbocharger that includes the assembly 200, a rotating compressor wheel positioned within the assembly 200 may draw in air via the fluid inlet opening 212 of the shell 210, cause the air to pass through the fluid inlet opening 262 of the insert 260 and be compressed and directed by the rotating compressor wheel past the shroud surface 266 and to a diffuser section formed in part by the diffuser surface 268 of the insert 260 (e.g., an a plate received by the recess 215 of the shell 210). From the diffuser section, the pressurized air may travel to the annular throat formed by the contoured edge 269 of the insert 260 and the lower region 221 of the inner surface 211 of the spiral wall portion 220 of the shell 210 where it enters the volute 213, eventually exiting via the fluid outlet opening 218.

As an example, an annular throat may have a substantially constant radial width where profiles of the lower region 221 of the inner surface 211 of the spiral wall portion 220 of the shell 210 and the contoured edge 269 of the insert 260 do not vary with respect to angle about the aligned longitudinal axes of the shell 210 and the insert 260. For example, where the outer most radius of the insert 260 and the radius of the lower region 221 of the inner surface 211 of the spiral wall portion 220 of the shell 210 are substantially constant with respect to azimuthal angle about the respective longitudinal axes of the insert 260 and the shell 210, the throat may also have a substantially constant radial width and profile. In such an example, the insert 260 may be seated in the shell 210 in any rotational orientation without altering the characteristics of the throat positioned between the diffuser section and the volute 213.

Figure 5:
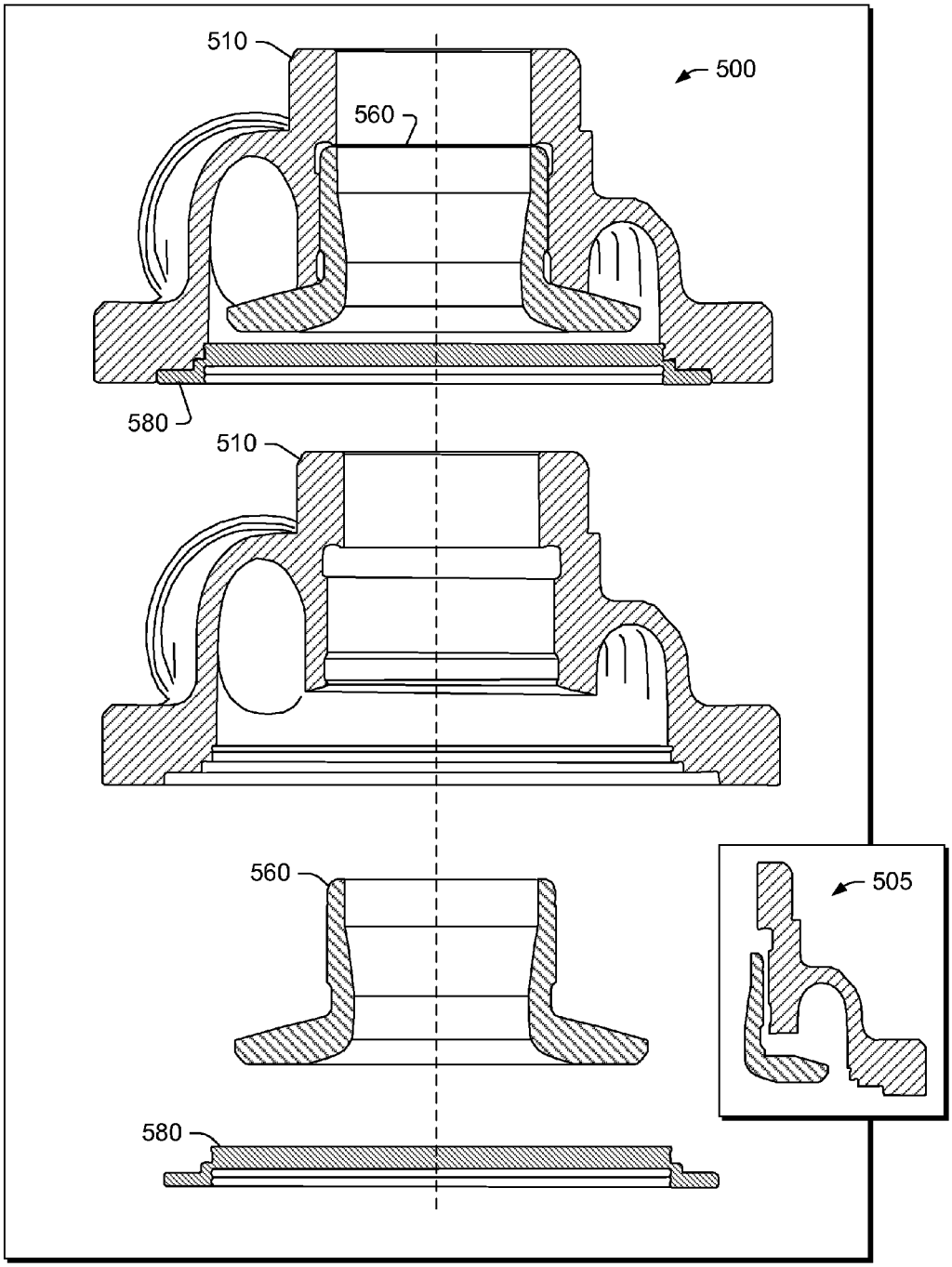
FIG. 5 is a cross-sectional view of an example of a compressor housing assembly.

FIG. 5 shows a series of cross-sectional views of an example of a compressor housing assembly 500 that includes a shell 510, an insert 560 and a plate 580. FIG. 5 also shows an alternative arrangement 505 where mating surfaces of the shell 510 and the insert 560 are substantially flat (e.g., zero slope) yet where the insert 560 still includes a sloped portion that defines, in part, a volute.

Figure 6:
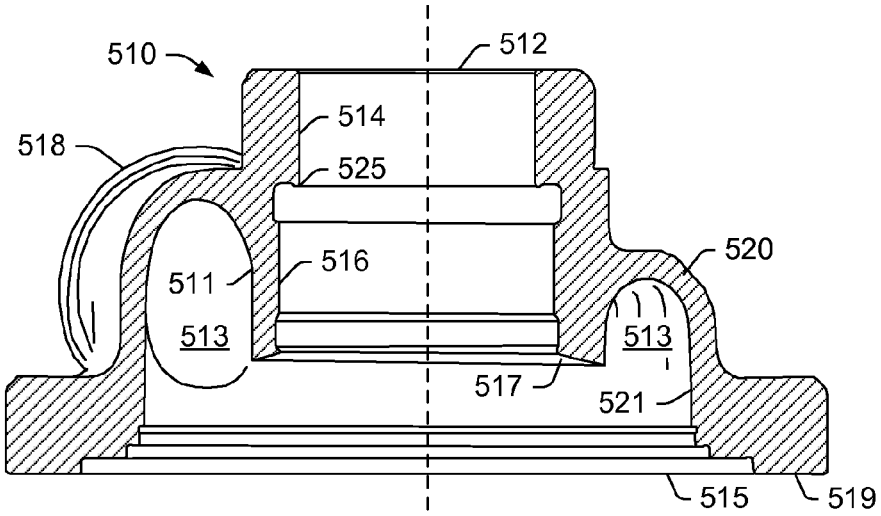
FIG. 6 is a series of views of a component of the compressor housing assembly of FIG. 5.
Figure 6:
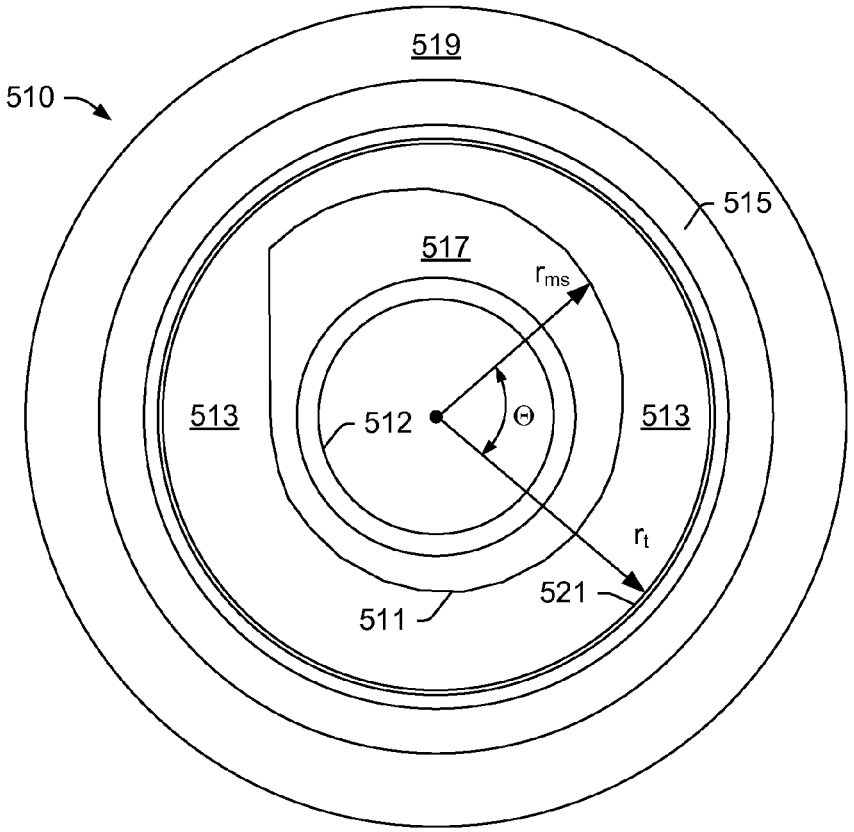

FIG. 6 shows the cross-sectional view of the shell 510 of FIG. 5 and a plan view of the shell 510, from below. As shown, the shell 510 includes a cylindrical wall portion with a fluid inlet opening 512, a wall 514, a shoulder 525, a seating wall 516 and a sloped mating surface 517. Extending radially outwardly from the cylindrical wall portion is a spiral wall portion 520, which includes an inner surface 511 to define, in part, a volute 513. As shown, the inner surface 511 also includes an axially lower region 521, which may define, in part, a throat (e.g., positioned between a diffuser section and the volute 513). In the example of FIG. 6, the shell 510 also includes a recess 515 for receipt of the plate 580, a fluid outlet opening 518 and a base surface 519, disposed about the recess 515. As seen in the plan view, the sloped mating surface 517 varies with respect to angle about a longitudinal axis of the shell 510. For example, the sloped mating surface 517 and an inner region of the surface 511 may be defined by a radius $r_{ms}$. Where the region 521 is defined by a radius $r_t$, the width of the volute 513 may include a maximum width of approximately $r_t - r_{ms}$.

Figure 7:
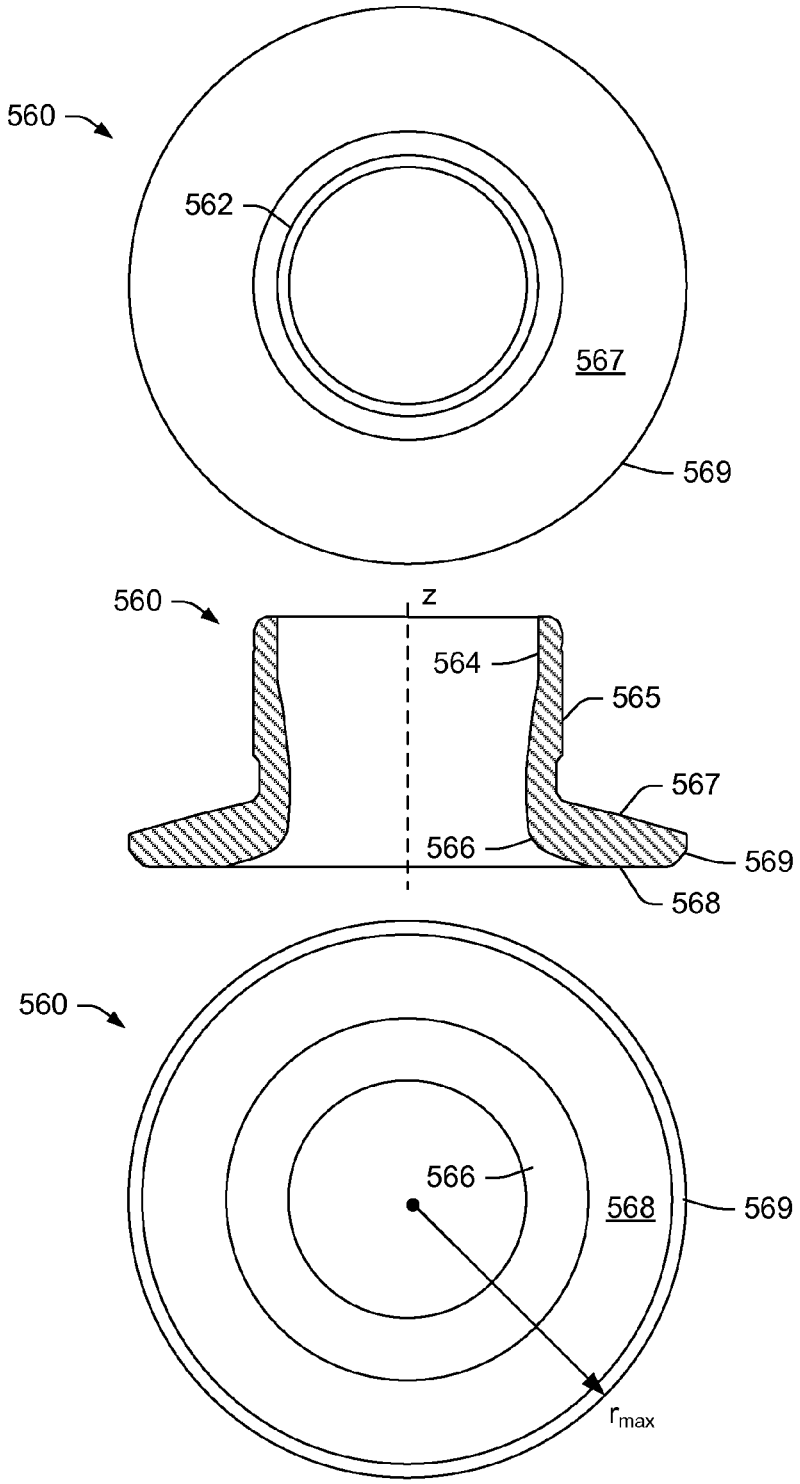
FIG. 7 is a series of views of another component of the compressor housing assembly of FIG. 5.

FIG. 7 shows the cross-sectional view of the insert 560 of FIG. 5, a plan view of the insert 560, from below, and a plan view of the insert 560, from above. In the plan view from below, a radius is shown as being a maximum radius $r_{max}$ of the insert 560. In the example of FIG. 7, the insert 560 has a constant maximum diameter, which is double the maximum radius. The insert 560 is also symmetrical about its longitudinal axis. Accordingly, given a shell such as the shell 510, the insert 560 may be inserted in any angular orientation about its longitudinal axis while still creating a suitable interface between its sloped mating surface 567 and the sloped mating surface 517 of the shell 510.

Figure 8:
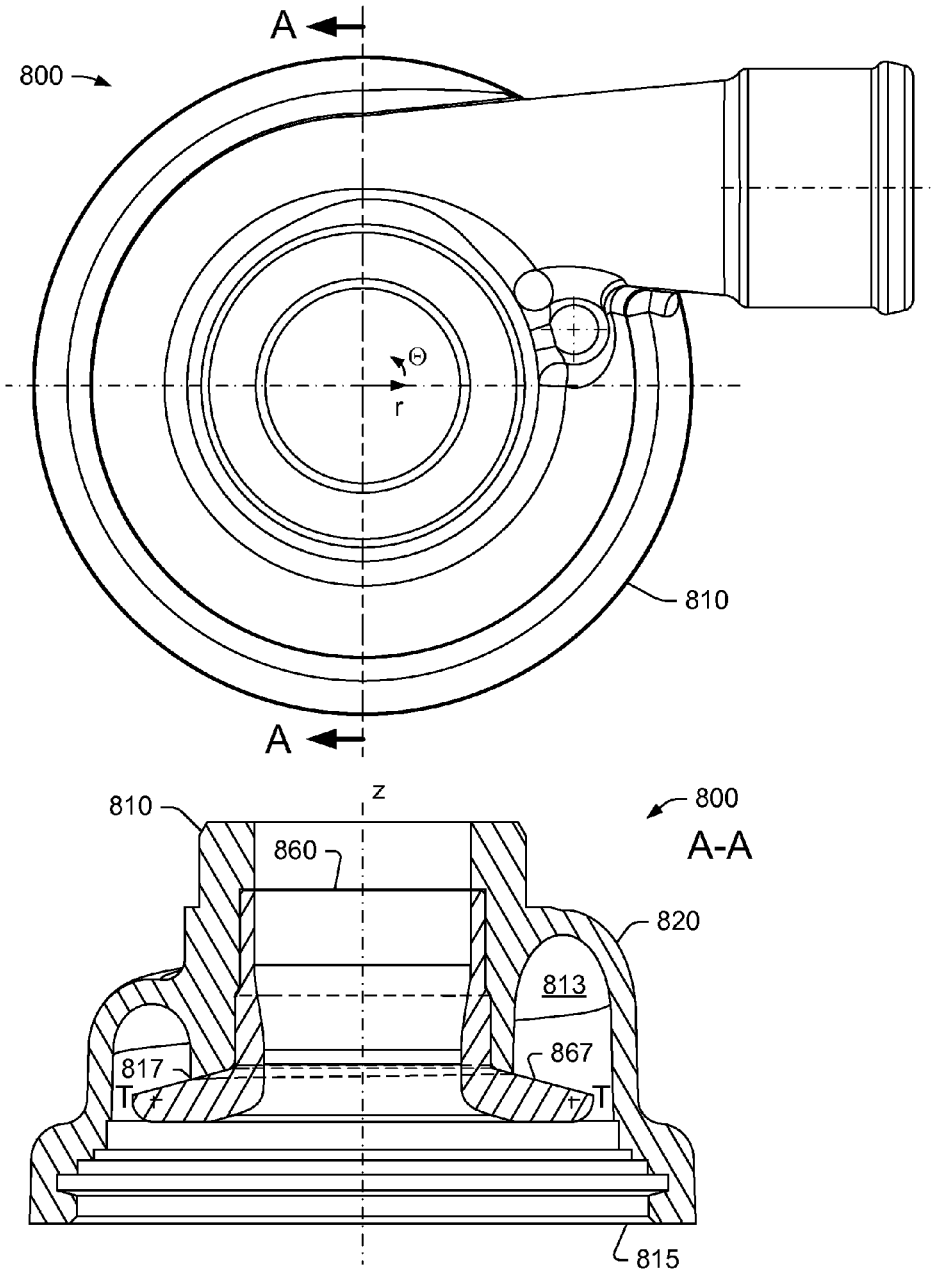
FIG. 8 is a series of views of an example of a compressor housing assembly.

FIG. 8 shows a plan view and a cross-sectional view along a line A-A of an example of a compressor housing assembly 800. In the example of FIG. 8, the assembly 800 includes a shell 810 and an insert 860. The shell 810 includes a wall 820 that defines, in part, a volute 813, and a recess 815, for example, for receipt of a plate (see, e.g., a plate such as the plate 580). As shown, the shell 810 includes a sloped mating surface 817 while the insert 860 includes a sloped mating surface 867, which also defines, in part, the volute 813. In the example of FIG. 8, the insert may be symmetric about its longitudinal axis, for example, to allow for positioning of the insert 860 into the shell 810 without regard to angular orientation of the insert 860 about its longitudinal axis. The cross-sectional view of FIG. 8 also shows the annular throat labeled "T", which, even though the cross-sectional area of the volute 813 differs, the throat width remains constant. Accordingly, the shell 810 may be formed by a die-casting process where one of the dies has a diameter that may be aligned along a longitudinal axis to form an inner surface 811 of the wall 820 to provide the assembly 800 with a volute 813 that has a constant maximum radius (e.g., diameter) about the longitudinal axis of the shell 810. Such an approach can provide for a constant minimum radial throat width (e.g., at a given plane orthogonal to a longitudinal axis of the assembly 800).

Figure 9:
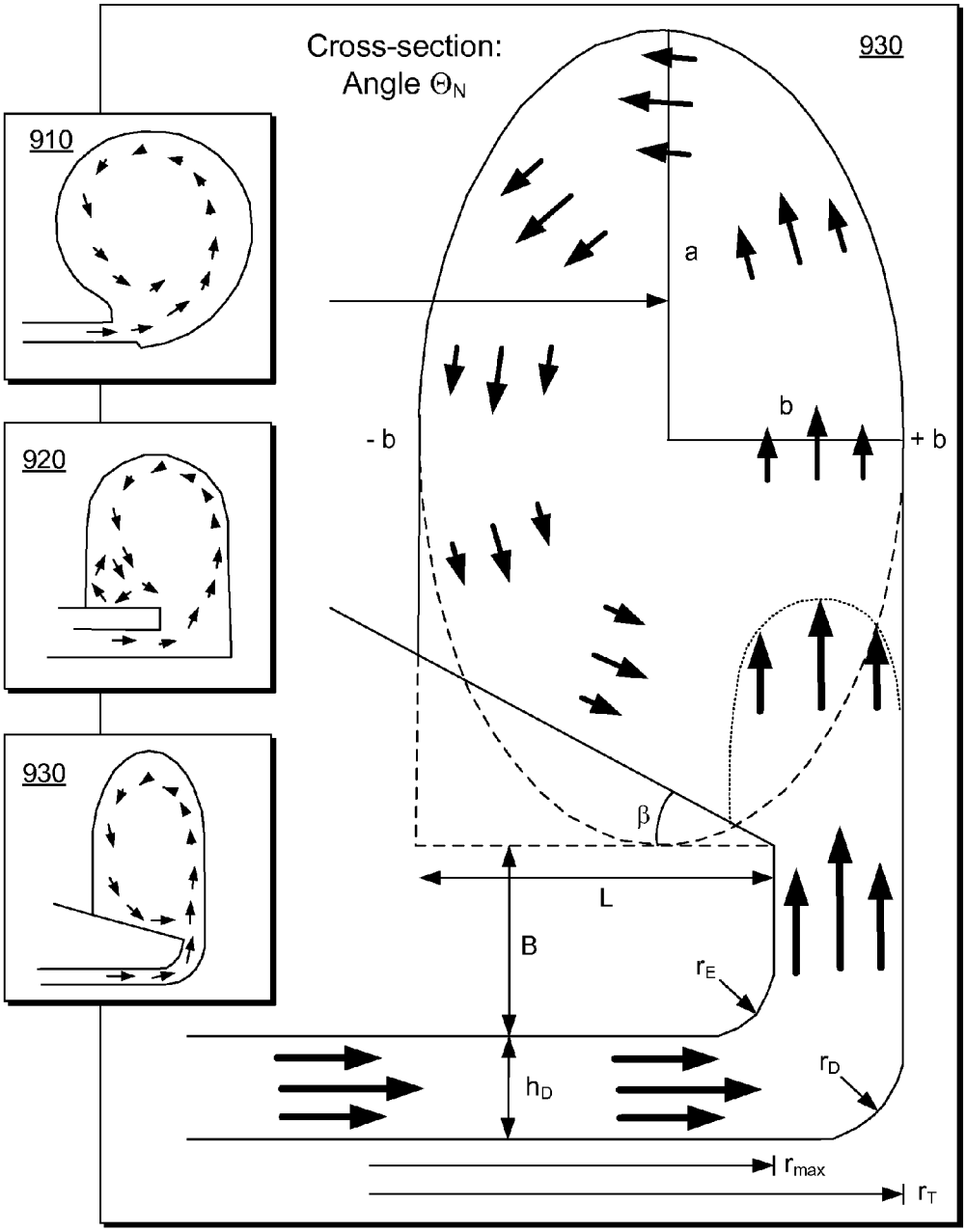
FIG. 9 is a diagram showing an example of approximate flow in a cross-sectional view of an example of a compressor housing assembly.

FIG. 9 shows approximate examples of fluid flow vectors in various assemblies 910, 920 and 930. In the assembly 910, the volute may be formed via sand casting a unitary component with a substantially circular cross-sectional area. In the assembly 920, the volute may be formed by die-casting a component that when assembled with another component, forms a volute with a 90 degree corner. In such an example, fluid flow may establish an eddy or other pattern that reduces efficiency. In the assembly 930, the volute may be formed by die-casting a component that includes a sloped mating surface that when assembled with another component that includes a sloped mating surface, forms a volute with a corner having an angle greater than 90 degrees (e.g., in cross-section). In such an example, the angle may be about 100 degrees to about 110 degrees (e.g., slope angle of a sloped mating surface of an insert may be about 10 degrees to about 20 degrees). As an example, an angle may be about 105 degrees (e.g., slope angle of a sloped mating surface of an insert may be about 15 degrees).

The enlarged diagram of FIG. 9 corresponds to the example assembly 930. In such an example, a volute may be defined by various parameters. For example, a volute may be defined, in part, by an equation for an ellipse having a semi-major axis dimension "a" and a semi-minor axis dimension "b". In such an example, a centroid of the ellipse may be defined as being a distance from a longitudinal axis of a component. As to a slope angle, the angle β is shown in the example of FIG. 9 as being defined with respect to a plane orthogonal to a longitudinal axis of a component. A parameter "B", may define an axial throat height (see, e.g., a contoured end of an insert). In the example of FIG. 9, an end of an insert may include a contour defined in part by a radius $r_E$. A plate (see, e.g., the plate 580), a shell or other component may include contour at a maximum throat radius (e.g., at $r_T$). Such features may act to reduce losses as compressed fluid flows from a diffuser to a volute. As to a diffuser section, it may be substantially flat, for example, disposed between two flat surfaces, with increasing cross-sectional flow area due to increasing radius. Spacing between such surfaces is shown in the example of FIG. 9 by the parameter $h_D$.

As an example, a parameter "L" may relate to the minor axis dimension "b" of the volute. For example, a ratio of L to 2*b (e.g., width of −b to +b) for a largest cross-sectional area of a volute with respect to azimuthal angle may be in a range, as a percentage, from about 80% to about 85%. As an example, another ratio may be defined as B to 2*b (e.g., width of −b to +b) where for a largest cross-sectional area of a volute with respect to azimuthal angle, it may be in a range, as a percentage, from about 15% to about 30%. As to the radius $r_E$, and optionally another radius at about $r_T$, these may be fillet radii selected to provide for a more gradual change in flow area from a diffuser section to a volute.

As an example, a compressor housing assembly can include a volute of varying cross-sectional areas, each cross-sectional area having a peak defined by a semi-major axis of a semi-ellipse (e.g., "a"), a width defined by twice a semi-minor axis of the semi-ellipse (e.g., "b", where width is 2*b), a first line extending downward from one side of the semi-ellipse at a semi-minor axis distance from a center of the semi-ellipse (e.g., +b) to one side of a throat and a second line, parallel to the first line, extending downward from another side of the semi-ellipse at a semi-minor axis distance from the center of the semi-ellipse (e.g., −b) to a sloped line that extends to another side of the throat. In such an example, the volute can include a throat with a constant throat width.

As to slope lines of cross-sectional areas of a volute, these lines may have a common slope. As an example, a common slope angle may be an angle in a range of about 10 degrees to about 20 degrees. As an example, for a larger cross-section of a volute (e.g., a largest cross-section before connection to an outlet), a distance from a second line to one side of a throat (e.g., L) divided by a width of a volute (e.g., 2*b) may provide value in a range of about 0.8 to about 0.85. As an example, for a larger cross-section of a volute (e.g., a largest cross-section before connection to an outlet), an axial height of a throat (e.g., B) divided by twice a semi-minor axis distance (e.g., 2*b, a width of −b to +b) may provide a value in a range of about 0.15 to about 0.30. As an example, over a range of azimuthal angles of a volute, a ratio of a semi-minor axis (e.g., "b") to a semi-major axis (e.g., "a") may be a value in a range of about 0.5 to about 1 (e.g., where unity would provide a radius of a semi-circle). As an example, for a larger cross-section of a volute (e.g., a largest cross-section before connection to an outlet), a ratio of a semi-minor axis (e.g., "b") to a semi-major axis (e.g., "a") may be about 0.6 (e.g., for a semi-ellipse with walls extending downward toward a diffuser from about −b and +b). As an example, the smallest cross-section of a volute may include a ratio of a semi-minor axis (e.g., "b") to a semi-major axis (e.g., "a") approaching 1 (e.g., a value larger than for the largest cross-section of the volute); alternatively, for an inverse ratio of a/b, the ratio may be greater than 1 and approach 1. As an example, a value for "a" may be less than "b" at a smallest volute cross-sectional area (e.g., ratio of b/a>1 or ratio of a/b<1).

As an example, a compressor housing assembly can include a shell that includes a cylindrical wall portion including a fluid inlet opening at one end and a sloped mating surface at an opposing end and, extending radially outwardly from the cylindrical wall portion, a spiral wall portion that defines, in part, a volute; and an insert that includes a cylindrical wall portion including a fluid inlet opening at one end and a shroud surface at an opposing end and, extending radially outwardly from the cylindrical wall portion, an annular ring portion including a sloped mating surface and, extending from the shroud surface, a diffuser surface, where, in an assembled state, the sloped mating surface of the insert and the sloped mating surface of the shell form a sloped interface between the insert and the shell. In such an example, the shell may be a die-cast shell (e.g., a shell formed via a die-casting process).

As an example, an insert may include a longitudinal axis and rotational symmetry about the longitudinal axis. In such an example, the insert may be rotationally orientation-less with respect to a shell (e.g., capable of being properly inserted into the shell regardless of azimuthal orientation).

As an example, a shell can include a longitudinal axis where a sloped mating surface of a cylindrical wall portion of the shell includes a surface area that varies with respect to azimuthal angle about the longitudinal axis.

As an example, an assembly can include an annular plate that includes a diffuser surface where, in an assembled state, the diffuser surface of the insert and the diffuser surface of the annular plate form a diffuser. For example, a center housing rotating assembly (CHRA) may include such a plate positioned between a compressor wheel and a center housing assembly. In such an example, the compressor wheel can include an inducer portion to receive fluid via a fluid inlet and an exducer portion to direct fluid to the diffuser (e.g., diffuser section).

As an example, a cylindrical wall portion of a shell can include an inner diameter that exceeds an outer diameter of a cylindrical wall portion of an insert to accommodate the insert in the shell. As an example, a shell can include a longitudinal axis where a spiral wall portion of the shell defines, in part, a volute as having a constant maximum radius with respect to azimuthal angles about the longitudinal axis. As an example, a shell can include a longitudinal axis where a spiral wall portion of the shell defines, in part, a volute as having a varying minimum radius with respect to azimuthal angles about the longitudinal axis. As an example, a shell can include a longitudinal axis where a spiral wall portion of the shell defines, in part, a volute as having a varying axial height with respect to azimuthal angles about the longitudinal axis.

As an example, a sloped mating surface of an insert may have a slope angle in a range of about 10 degrees to about 20 degrees. As an example, a sloped mating surface of an insert may have a slope angle of about 15 degrees.

Figure 10:
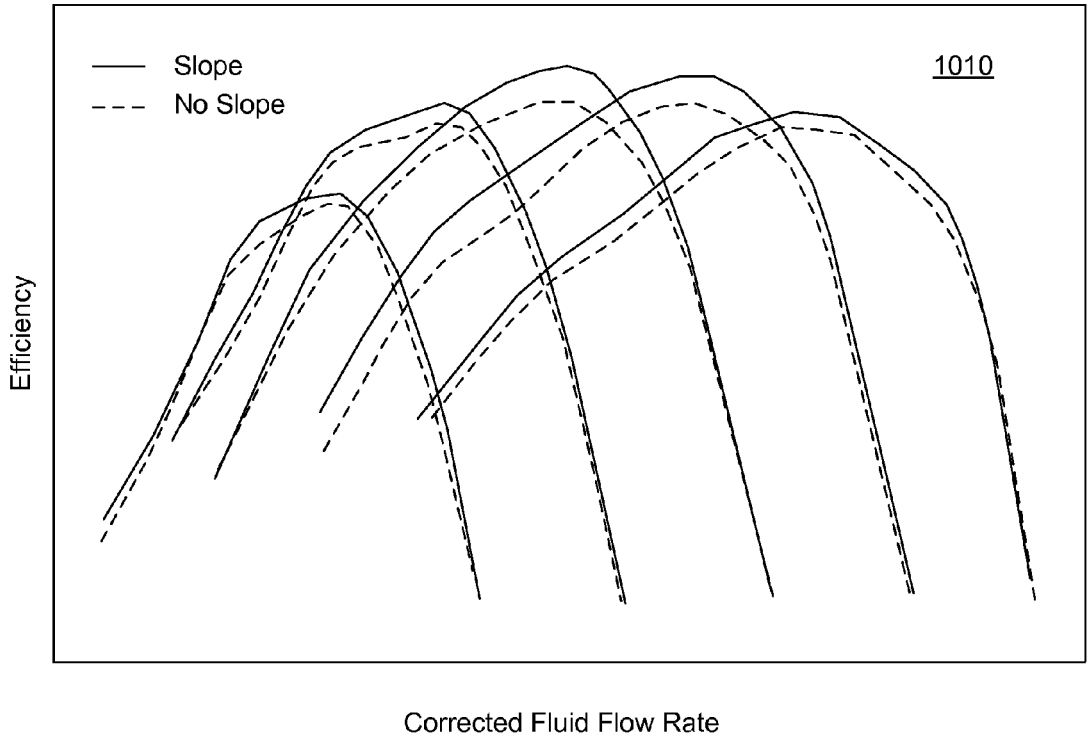
FIG. 10 is an example of a plot of trial data for compressor housing assemblies.

FIG. 10 shows a plot 1010 of efficiency versus corrected fluid flow rate for trial data for two compressor housing assemblies, one including sloped mating surfaces and one without sloped mating surfaces. As indicated by the trial data, the compressor housing assembly with the sloped mating surfaces exhibits higher peak efficiency.

Figure 11:
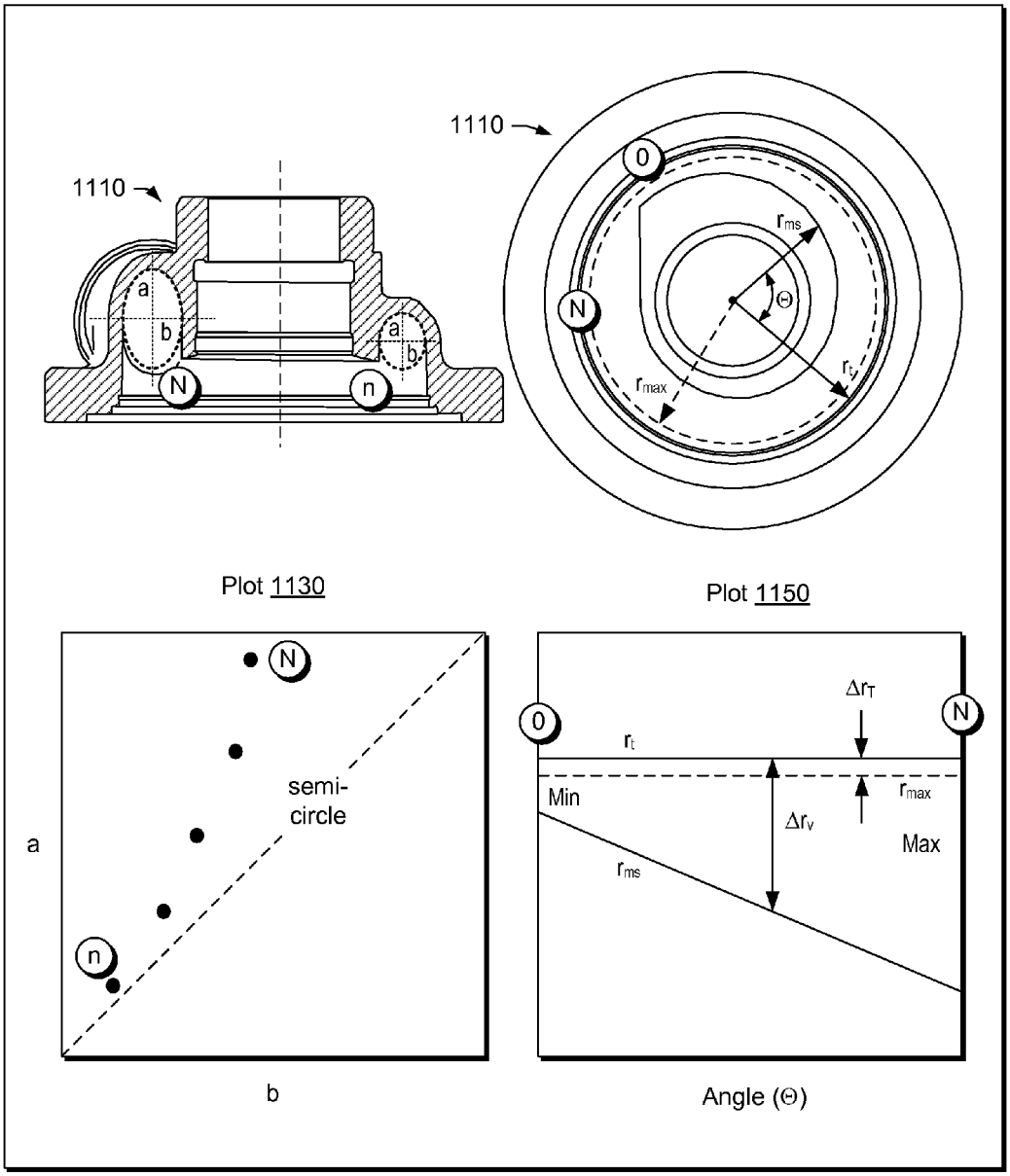
FIG. 11 is an example of a shell and examples of plots of parameters that can define, in part, a volute.

FIG. 11 shows an example of a shell 1110 of a compressor housing assembly and examples of plots 1130 and 1150 of some parameters that may define, in part, a volute of a compressor housing assembly. In a cross-sectional view of the shell 1110, parameters "a" and "b" are shown for two cross-sections "n" and "N" of a portion of a volute and in a bottom plan view of the shell 1110, parameters $r_t$ and $r_{ms}$ are shown with respect to azimuthal angle with angular positions "0" and "N" labeled and a dashed line is shown to indicate radius $r_{max}$ of an insert, for example, which can define a throat width $\Delta r_T$ with respect to $r_t$. In the example of FIG. 11, "0" may correspond to a minimum volute cross-sectional area and "N" may correspond to a maximum volute cross-sectional area.

In the plot 1130, where a portion of a volute cross-section may be represented as an ellipse, a semi-major axis parameter "a" and a semi-minor axis parameter "b" are shown for angular positions including and between "n" and "N". As indicated, as the cross-sectional area becomes smaller, the ratio a/b approaches a diagonal line, which represents a semi-circle. At the angular position "N", the value of the parameter "a" exceeds the value of the parameter "b". The plot 1130 does not show values for positions between "n" and "0", however, such values may follow the trend of the plot 1130 where for the position "0", the ratio a/b may be close to unity.

In the plot 1150, the radius $r_t$ is shown as being constant over the range of angles from the position "0" to the position "N" while the radius $r_{ms}$ is shown as increasing (e.g., to define a minimum value for $\Delta r_v$ and a maximum value for $\Delta r_v$). Also shown, as a dashed line, is $r_{max}$, which may define $\Delta r_T$ with respect to $r_t$. Referring to FIG. 9, value for the parameter L may change in a manner related to the radius $r_{ms}$ and, for example, the value $\Delta r_v$ may be defined as twice the semi-minor axis "b". As to a spiral, as an example, a spiral may be defined (e.g., at least in part) by a mathematical relationship (e.g., Archimedean spiral, logarithmic spiral, etc.).

Ratios and percentages mentioned for various parameters (see, e.g., FIG. 9) may be plotted in a manner, for example, as in the plots 1130 and 1150 of FIG. 11 (e.g., to show angular dependence). For example, for a largest cross-section that corresponds to the largest semi-minor axis value or width (e.g., 2*b), percentagewise, the value of the parameter L may be a value within a range from about 80% of 2*b to about 85% of 2*b. As an example, for a largest cross-section that corresponds to the largest semi-minor axis value or width (e.g., 2*b), percentagewise, the value of the parameter B may be a value within a range from about 15% to about 30%. In various examples, values for the parameter B remain constant with respect to azimuthal angle while values for the parameter L can change, again, as volute cross-section changes with respect to the parameters "a" and "b". As to the parameter L, it may change, for example, under a condition that an insert is symmetric about its axis (e.g., that an insert has a constant $r_{max}$).

Figure 12:
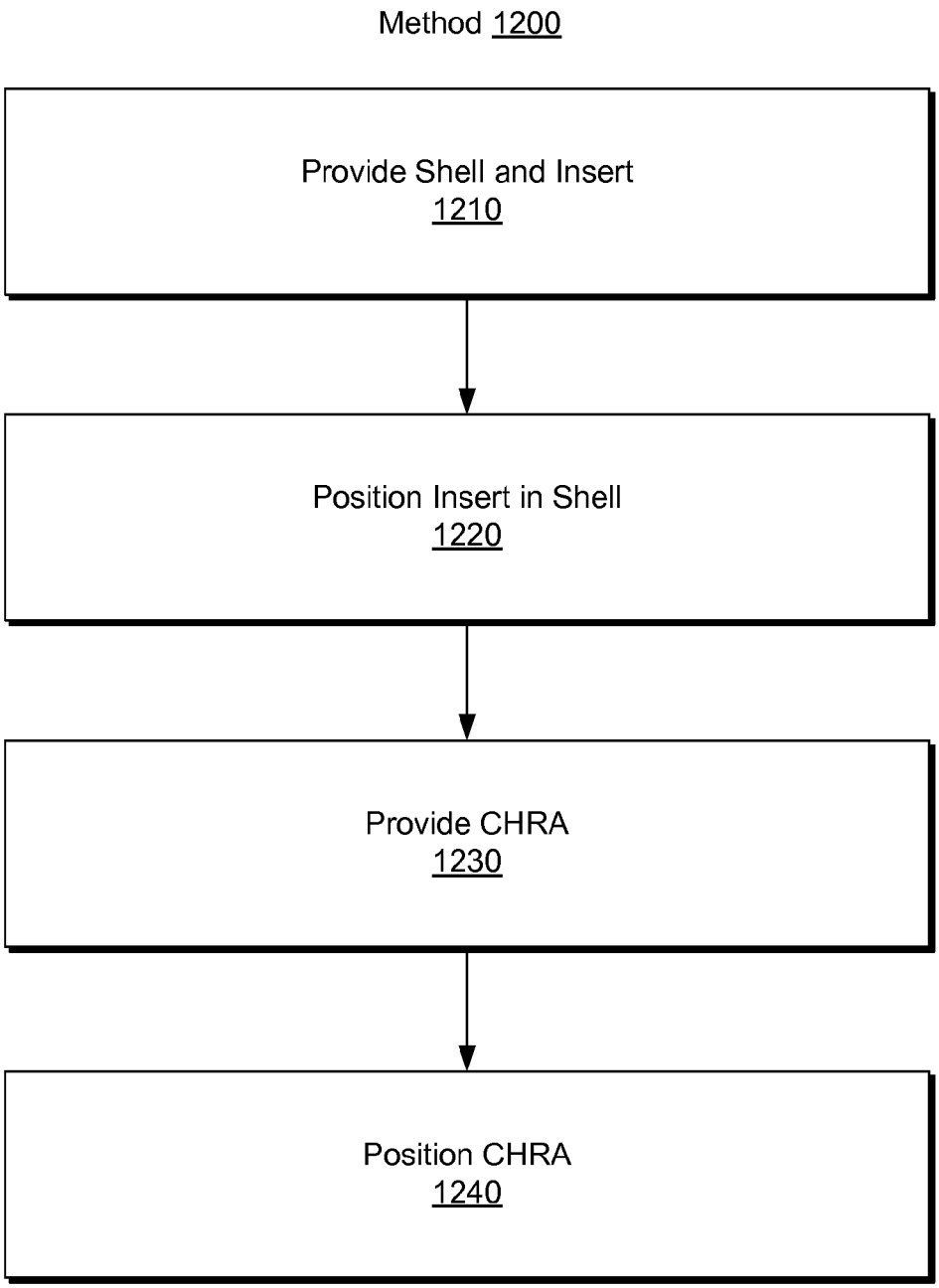
FIG. 12 is a block diagram of a method.

FIG. 12 shows an example of a method 1200 that includes a provision block 1210 for providing a shell and an insert, a position block 1220 for positioning the insert with respect to the shell, a provision block 1230 for providing a center housing rotating assembly (CHRA) that includes a compressor wheel and a plate and a position block 1240 for positioning the compressor wheel with respect to the positioned insert and for positioning the plate with respect to the shell (e.g., to form a diffuser section). In such an example, the position block 1220 may include positioning the insert without regard to azimuthal orientation about a longitudinal axis of the insert with respect to the shell. For example, the provision block 1210 may provide an insert having symmetry about its longitudinal axis. Further, the provision block 1210 may provide a shell with a sloped mating surface and an insert with a slope mating surface where the positioning block 1220 includes forming an interface between the sloped mating surfaces.

As an example, a method can include providing a die-cast shell and an insert where the die-cast shell includes a cylindrical wall portion including a fluid inlet opening at one end and a sloped mating surface at an opposing end and, extending radially outwardly from the cylindrical wall portion, a spiral wall portion that defines, in part, a volute and where the insert includes a cylindrical wall portion including a fluid inlet opening at one end and a shroud surface at an opposing end and, extending radially outwardly from the cylindrical wall portion, an annular ring portion including a sloped mating surface and, extending from the shroud surface, a diffuser surface; and positioning the insert with respect to the die-cast shell to form a sloped interface between the sloped mating surface of the insert and the sloped mating surface of the shell. Such a method may further include providing a center housing rotating assembly (CHRA) that includes a compressor wheel and a plate and positioning the compressor wheel with respect to the insert as positioned with respect to the die-cast shell and positioning the plate with respect to the die-cast shell to form a diffuser section.

As an example, a sloped insert surface can reduce corner sharpness compared to an assembly such as the assembly 920 of FIG. 9. In turn, aerodynamic performance of a compressor housing assembly may be improved (e.g., by making the volute section closer to circle as in the assembly 910 of FIG. 9, which may be formed via a sand casting process).

As an example, a diffuser section of a compressor housing assembly may be vaneless and one or more fillet radii may be used to connect the vaneless diffuser to a volute (e.g., to create a more smooth transition and to reduce losses).

As an example, diffuser section length may be extended through use of components such as in the assemblies 200, 500 and 800. In particular, a longer diffuser section (e.g., radial length) may be achieved while keeping the same overall housing diameter by placing smaller volute cross sections to the same outer diameter as the larger sections (see, e.g., the dimension $r_t$). Where an insert has symmetry about a longitudinal axis, need for a pin to control tangential position of the insert may be alleviated (e.g., as in conventional asymmetric approaches), which may reduce manufacturing cost, assembly time, part count, etc.

As an example, a compressor housing assembly with a die-cast shell, in comparison to a sand cast unitary component, may provide for a reduction in radial dimension (e.g., a die-cast housing may be about 20% smaller in radial dimension that a sand cast housing, while still achieving similar performance).

Although some examples of methods, devices, systems, arrangements, etc., have been illustrated in the accompanying Drawings and described in the foregoing Detailed Description, it will be understood that the example embodiments disclosed are not limiting, but are capable of numerous rearrangements, modifications and substitutions.

What is claimed is:

1. A compressor housing assembly comprising:

a shell that comprises a cylindrical wall portion including a fluid inlet opening at one end and a sloped mating surface at an opposing end and, extending radially outwardly from the cylindrical wall portion, a spiral wall portion that defines, in part, a volute; and an insert that comprises a cylindrical wall portion including a fluid inlet opening at one end and a shroud surface at an opposing end and, extending radially outwardly from the cylindrical wall portion, an annular ring portion including a sloped annular surface and, extending from the shroud surface, an annular diffuser surface, wherein the sloped annular surface comprises a sloped mating surface and a sloped volute surface that comprise a common slope angle in a range of 10 degrees to 20 degrees and wherein the annular diffuser surface comprises an angle of approximately 0 degrees, and wherein, in an assembled state, the sloped mating surface of the insert and the sloped mating surface of the shell form a sloped interface between the insert and the shell and the sloped volute surface of the insert defines, in part, the volute.

2. The compressor housing assembly of claim 1 wherein the insert comprises a longitudinal axis and rotational symmetry about the longitudinal axis.

3. The compressor housing assembly of claim 1 wherein the shell comprises a longitudinal axis and wherein the sloped mating surface of the cylindrical wall portion of the shell comprises a surface area that varies with respect to azimuthal angle about the longitudinal axis.

4. The compressor housing assembly of claim 1 further comprising an annular plate that comprises a diffuser surface wherein, in an assembled state, the annular diffuser surface of the insert and the diffuser surface of the annular plate form a diffuser.

5. The compressor housing assembly of claim 4 further comprising a compressor wheel that comprises an inducer portion to receive fluid via the fluid inlet and an exducer portion to direct fluid to the diffuser.

6. The compressor housing assembly of claim 1 wherein the cylindrical wall portion of the shell comprises an inner diameter that exceeds an outer diameter of the cylindrical wall portion of the insert to accommodate the insert in the shell.

7. The compressor housing assembly of claim 1 wherein the shell comprises a longitudinal axis and wherein the spiral wall portion of the shell defines, in part, the volute as having a constant maximum radius with respect to azimuthal angles about the longitudinal axis.

8. The compressor housing assembly of claim 1 wherein the shell comprises a longitudinal axis and wherein the spiral wall portion of the shell defines, in part, the volute as having a varying minimum radius with respect to azimuthal angles about the longitudinal axis.

9. The compressor housing assembly of claim 1 wherein the shell comprises a longitudinal axis and wherein the spiral wall portion of the shell defines, in part, the volute as having a varying axial height with respect to azimuthal angles about the longitudinal axis.

10. The compressor housing assembly of claim 1 wherein the sloped mating surface of the insert comprises a slope angle of 15 degrees.

11. The compressor housing assembly of claim 1 wherein the shell comprises a die-cast shell.

12. A compressor housing assembly comprising a volute of varying cross-sectional areas, each cross-sectional area having a peak defined by a semi-major axis of a semi-ellipse, a width defined by twice a semi-minor axis of the semi-ellipse, a first line extending downward from one side of the semi-ellipse at a semi-minor axis distance from a center of the semi-ellipse to one side of a throat and a second line, parallel to the first line, extending downward from another side of the semi-ellipse at a semi-minor axis distance from the center of the semi-ellipse to a sloped line that extends to another side of the throat.

13. The compressor housing assembly of claim 12 wherein the volute comprises a constant throat width.

14. The compressor housing assembly of claim 12 wherein for each of the cross-sectional areas, the slope lines comprise a common slope angle.

15. The compressor housing assembly of claim 14 wherein the common slope angle comprises an angle in a range of 10 degrees to 20 degrees.

16. The compressor housing assembly of claim 12 wherein a distance from the second line to the other side of the throat divided by the width comprises a value in a range of 0.8 to 0.85.

17. The compressor housing assembly of claim 12 wherein an axial height of the throat divided by twice the semi-minor axis distance comprises a value in a range of 0.15 to 0.30.

18. A method comprising:

providing a die-cast shell and an insert wherein the die-cast shell comprises a cylindrical wall portion including a fluid inlet opening at one end and a sloped mating surface at an opposing end and, extending radially outwardly from the cylindrical wall portion, a spiral wall portion that defines, in part, a volute and wherein the insert comprises a cylindrical wall portion including a fluid inlet opening at one end and a shroud surface at an opposing end and, extending radially outwardly from the cylindrical wall portion, an annular ring portion including a sloped annular surface and, extending from the shroud surface, an annular diffuser surface, wherein the sloped annular surface comprises a sloped mating surface and a sloped volute surface that comprise a common slope angle in a range of 10 degrees to 20 degrees and wherein the annular diffuser surface comprises an angle of approximately 0 degrees; and positioning the insert with respect to the die-cast shell to form a sloped interface between the sloped mating surface of the insert and the sloped mating surface of the shell and the sloped volute surface of the insert defines, in part, the volute.

19. The method of claim 18 further comprising providing a center housing rotating assembly that comprises a compressor wheel and a plate and positioning the compressor wheel with respect to the insert as positioned with respect to the die-cast shell and positioning the plate with respect to the die-cast shell to form a diffuser section.

* * * * *